US009118096B2

(12) United States Patent
Henderson et al.

(10) Patent No.: US 9,118,096 B2
(45) Date of Patent: Aug. 25, 2015

(54) WEARABLE ANTENNA HAVING A MICROSTRIP FEED LINE DISPOSED ON A FLEXIBLE FABRIC AND INCLUDING PERIODIC APERTURES IN A GROUND PLANE

(75) Inventors: Robert Ian Henderson, Chelmsford (GB); James Christopher Gordon Matthews, Chelmsford (GB)

(73) Assignee: BAE SYSTEMS plc, London (GB)

( * ) Notice: Subject to any disclaimer, the term of this patent is extended or adjusted under 35 U.S.C. 154(b) by 166 days.

(21) Appl. No.: 13/702,348

(22) PCT Filed: Jun. 29, 2011

(86) PCT No.: PCT/GB2011/000994

§ 371 (c)(1),
(2), (4) Date: Dec. 6, 2012

(87) PCT Pub. No.: WO2012/011367

PCT Pub. Date: Jan. 5, 2012

(65) Prior Publication Data

US 2013/0088304 A1 Apr. 11, 2013

(30) Foreign Application Priority Data

Jun. 30, 2010 (EP) ..... 10275069
Jun. 30, 2010 (GB) ..... 1010988.2

(51) Int. Cl.
*H01P 3/02* (2006.01)
*H01P 3/08* (2006.01)
(Continued)

(52) U.S. Cl.
CPC ..... *H01P 3/026* (2013.01); *H01P 3/081* (2013.01); *H01Q 1/273* (2013.01); *H01Q 1/38* (2013.01); *H01Q 9/285* (2013.01)

(58) Field of Classification Search
CPC ..... H01P 3/081; H01Q 1/273
USPC ..... 333/238; 343/718, 821
See application file for complete search history.

(56) References Cited

U.S. PATENT DOCUMENTS 2,721,312 A * 10/1955 Grieg et al. ..... 333/238
4,513,292 A * 4/1985 Bowman ..... 343/795
(Continued)

FOREIGN PATENT DOCUMENTS

GB 2081559 A 2/1982
JP 2006197072 A 7/2006
(Continued)

OTHER PUBLICATIONS

Great Britain Search Report regarding Application No. GB1010988.2, dated Oct. 26, 2010, 6 pages.
(Continued)

*Primary Examiner* — Benny Lee
(74) *Attorney, Agent, or Firm* — Finch & Maloney PLLC

(57) ABSTRACT

A feed structure for a wearable antenna incorporates a microstrip transmission line designed for mounting on opposite sides of a fabric. The transmission line has a perforated ground plane which reduces capacitance and offers an appropriate impedance, even when the fabric is thin, and allows the use of a relatively robust line conductor having a width of 3 mm or 5 mm or more. The ground plane can be extended to provide the ground plane of a balun and the material of that ground plane can in turn be extended to provide the wearable antenna.

12 Claims, 5 Drawing Sheets

(51) Int. Cl.

| | |
|---|---|
| ***H01Q 1/27*** | (2006.01) |
| ***H01Q 1/38*** | (2006.01) |
| ***H01Q 9/28*** | (2006.01) |

(56) References Cited

U.S. PATENT DOCUMENTS

| | | | | |
|---|---|---|---|---|
| 4,647,281 | A * | 3/1987 | Carr | 604/503 |
| 4,825,220 | A * | 4/1989 | Edward et al. | 343/795 |
| 5,631,446 | A * | 5/1997 | Quan | 174/254 |
| 5,815,122 | A | 9/1998 | Nurnberger et al. | |
| 7,102,456 | B2 * | 9/2006 | Berg | 333/4 |
| 2002/0084876 | A1 | 7/2002 | Wright et al. | |
| 2005/0110680 | A1 * | 5/2005 | Tanaka et al. | 343/700 MS |
| 2006/0119525 | A1 | 6/2006 | Cohen | |
| 2009/0295657 | A1 * | 12/2009 | Gakhar et al. | 343/718 |
| 2010/0141541 | A1 * | 6/2010 | Kuramoto | 343/718 |

FOREIGN PATENT DOCUMENTS

| | | | |
|---|---|---|---|
| JP | 2010068163 | A | 3/2010 |
| WO | 9816966 | A1 | 4/1998 |
| WO | 2005107009 | A2 | 11/2005 |
| WO | 2009030039 | A1 | 3/2009 |
| WO | 2009136837 | A1 | 11/2009 |

OTHER PUBLICATIONS

International Search Report and Written Opinion regarding PCT/GB2011-000994, mailed Aug. 19, 2011, 9 pages.

European Search Report regarding Application No. EP10275069.2, dated Sep. 28, 2010, 6 pages.

Nguyen and Smith, Novel miniaturised wideband baluns for MIC and MMIC applications, Electronics Letters, vol. 29, No. 12, published on Jun. 10, 1993.

International Preliminary Report on Patentability for PCT/GB2011/000994, mailed Jan. 17, 2013, 5 pages.

* cited by examiner

- Prior Art -

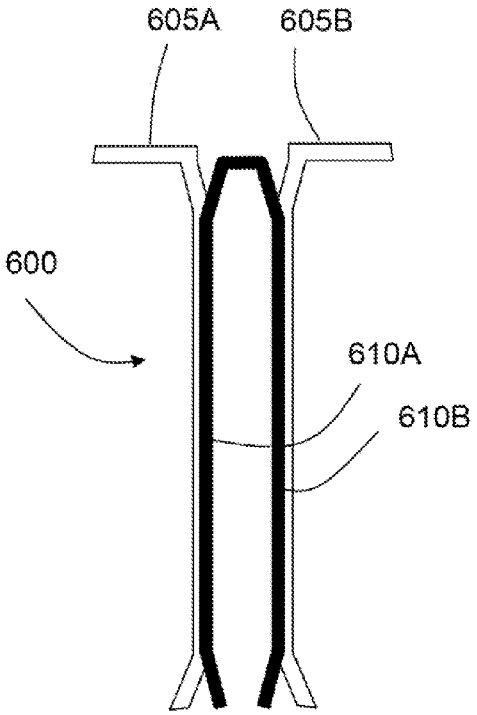
FIGURE 6
FIGURE 7
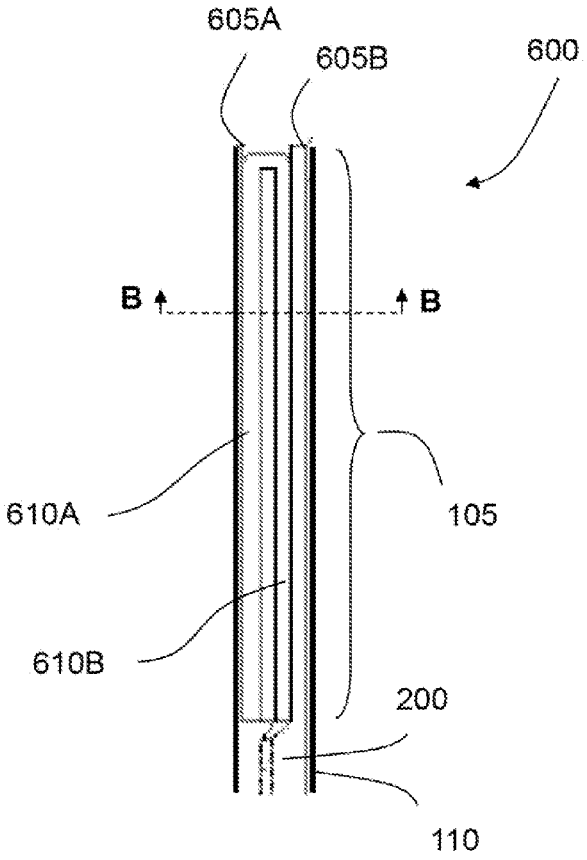

WEARABLE ANTENNA HAVING A MICROSTRIP FEED LINE DISPOSED ON A FLEXIBLE FABRIC AND INCLUDING PERIODIC APERTURES IN A GROUND PLANE

CROSS-REFERENCE TO RELATED APPLICATIONS

This application is a U.S. National Stage application under 35 USC §371 of PCT/GB2011/000994 filed 29 Jun. 2011, which claims priority under the Paris Convention to European Patent Application 10275069.2 filed 30 Jun. 2010, and British Patent Application 1010988.2 filed 30 Jun. 2010, the entire contents of both applications being incorporated herein by reference.

BACKGROUND

The present invention relates to a feed structure for an antenna. Embodiments of the invention find particular application in flexible feed structures for radio antennas, such as those which can be incorporated into clothing.

Wearable antennas have been developed for use in variety of communications applications. The construction of an antenna using flexible materials has been investigated and can give a relatively discreet result which does not hinder the wearer's movements.

There are several challenges in developing a wearable antenna which can for example be incorporated into clothing. One of these is the feed for delivering communications signals to/from the antenna, these signals normally being at radio frequencies. The feed itself needs to deliver sufficient power while being relatively undetectable and also robust, for instance to withstand normal movement and handling of the clothing, and washing.

A dipole antenna is a form of antenna known for use in a wearable construction but, in practice, it requires a balanced feed in order to prevent the feed itself from radiating as well as the antenna. If the feed radiates, it reduces the efficiency of the antenna, can distort the radiation/reception pattern and can interfere with other equipment. The output of a radio for use with a wearable communications antenna is unbalanced. It is known to use a transmission line plus a balun to convert the radio output to a balanced antenna feed.

Other constraints with regard to an antenna feed suitable for wearable antennas are that it should be compatible with broadband operation and deliver an adequate signal power for use in the field, for example 5 Watts or more.

SUMMARY OF THE INVENTION

According to a first aspect of the present invention, there is provided an antenna feed structure for use with a wearable antenna, the feed structure comprising a microstrip line having a line conductor and a ground plane for mounting on opposite sides of a flexible material, the ground plane having a series of apertures therein, at least partially facing the line conductor when mounted.

Such a microstrip line might be connected to a balun to provide a balanced feed to a planar antenna.

Typically, wearable cloth substrates, such as cotton, are often no more than 1 mm thick and can be no more than 0.5 mm or 0.3 mm. It has been found that, in a microstrip line of conventional design, having a line conductor and a continuous ground plane on opposite sides of a typical, wearable cloth substrate, the conductor has to be very narrow in order to achieve an impedance suitable for use with a communications radio. For example, if the radio has a 50 ohm input/output impedance and the cloth substrate is 0.3 mm thick, the width of the line conductor has to be of the order of 0.8 mm in order to match that impedance. Such narrow conductors are very difficult to realize and are fragile in use.

Embodiments of the invention allow a significantly wider conductor to be used to achieve the same impedance by reducing the capacitance of the microstrip line per unit length. A simple means of doing this is to remove sections of the ground plane below the line conductor, thereby reducing the amount of material in the ground plane per unit length.

In use, the line conductor will be affected by the proximity of the ground plane to the body, and will also lose a fraction of the power by induced currents in the body. However, these effects can be kept relatively small as long as the spacing of the removed sections is kept small relative to the signal carrier wavelength. For example, it would be preferable to have five or more, or even ten or more, removed sections per carrier wavelength in the material. This effectively presents a reduced averaged capacitance in the transmission line and avoids problems with matching the line to an antenna.

In embodiments of the invention, although not essential, the apertures in the ground plane might be periodic. For example, they might be provided by circular or rectangular openings providing a ladder-like structure. These openings are preferably at least as wide as the line conductor so as to have maximum effect in reducing the amount of ground plane per unit length. An important factor will therefore be the "duty ratio" of the periodic structure in the ground plane.

According to a second aspect of the present invention, there is provided a wearable antenna assembly comprising a dipole antenna and an antenna feed structure, the assembly being carried at least partially on opposite sides of wearable fabric, and the antenna and feed structure having ground planes constructed from a shared, continuous piece of material. The wearable antenna assembly may comprise an antenna feed structure according to an embodiment of the invention in its first aspect, the feed structure being supported on opposite sides of flexible material having a thickness of not more than 1 mm.

It has been found possible to construct an embodiment of the invention on materials no thicker than 0.5 mm and even on cotton having a thickness of only 0.3 mm. A conventional transmission line feed for an antenna would normally present considerable problems at these separations between the ground plane and the line conductor, particularly in terms of fragility, to achieve appropriate impedance. The perforated ground plane allows a wider line conductor to be used to achieve impedance in a convenient range, preferably around 50 ohms but optionally in the range from 35 ohms to 65 ohms, and this in turn means lower resistance and therefore lower loss.

Rather than printing or otherwise providing the components of the transmission line directly onto a wearable material, it may be preferred to construct the components separately and then attach them to the wearable material. For example, the transmission line components might be constructed out of a metallized carrier such as a metallized fabric. A practical option is laser-cut, metallized nylon which offers quite high precision without adding thickness or stiffness to the wearable material.

Embodiments of the invention allow a suitable antenna feed structure to be provided to communicate signals in a preferred frequency range of approximately 50-500 MHz in spite of the tight requirements of wearable antennas in terms of detectability, robustness and electrical parameters.

BRIEF DESCRIPTION OF THE FIGURES

An antenna feed structure will now be described as an embodiment of the invention, by way of example only, with reference to the following figures where like features are designated with like numerals and in which:

FIG. 6 shows a diagrammatic plan view of the main elements of a planar Marchand balun;

FIG. 7 shows a diagrammatic plan view of a planar Marchand balun for use in the feed structure of FIG. 1;

DETAILED DESCRIPTION OF THE INVENTION

Figure 1:
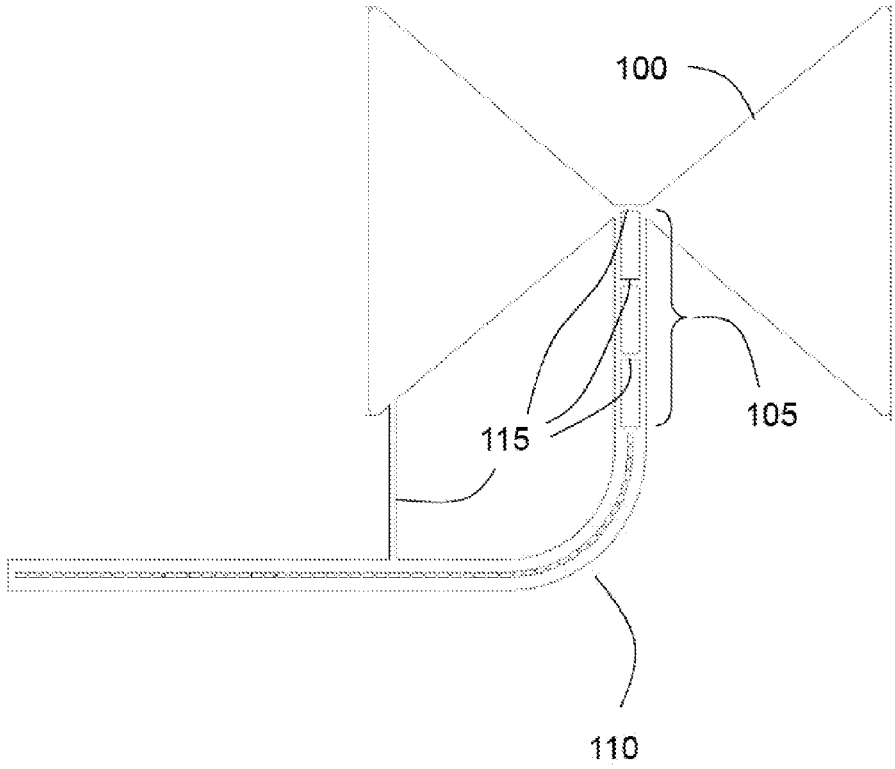
FIG. 1 shows a diagrammatic view from below of a bowtie antenna having a feed structure comprising an embodiment of the invention, during construction.

Referring to FIG. 1, in practice, a bowtie antenna 100 with a ground plane for its feed structure 105, 110 can be fabricated from a sheet of conductive material, prior to mounting on a wearable fabric. The antenna 100 as shown will be mounted on the inside of the wearable fabric and comprises a low-band bow-tie antenna 100 connected to the ground plane 110 of a transmission line feed via the ground plane 105 of a Marchand balun. Thus in this embodiment the antenna and its feed structure share a continuous ground plane in that the ground plane of each is constructed from the same, continuous piece of material.

A suitable balun is further discussed below with reference to FIGS. 5 and 6.

The antenna 100 is of known type, being a bow-tie dipole.

The ground plane of the transmission line feed 110 is perforated and provides part of a 50 ohm microstrip line which is further described below with particular reference to FIGS. 2 to 4. To obtain vertical polarisation, the microstrip line, and therefore the ground plane 110, is taken round a 90° bend to meet the ground plane 110 of the balun 105.

FIG. 1 also shows strips 115 joining the antenna 100 to the ground plane of the transmission line feed 110 and joining parts of the ground plane 105 of the Marchand balun but these strips 115 are only to aid positioning when attaching the antenna and feed structure to the wearable fabric and would be removed from the finished product.

Figure 2:
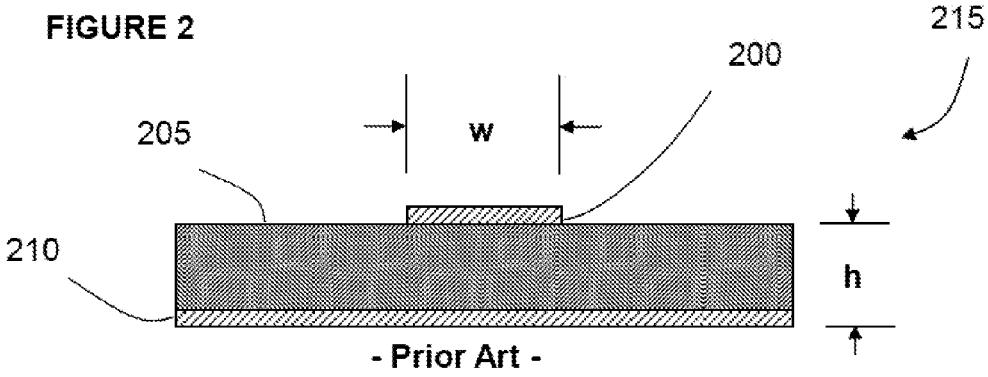
FIG. 2 shows a vertical cross section through a conventional microstrip feed line for an antenna.

Referring to FIG. 2, important aspects of a transmission line feed 215 suitable for use in embodiments of the invention, which can be constructed using conductive fabrics, are:

- power handling of the conducting fabric when used as a transmission line
- effect on impedance due to coupling into the body, in use
- thickness achievable across typical wearable fabrics The transmission line feed 215 of FIG. 2 is provided by a conductor 200 having width "w" and a ground plane 210, on opposite sides of the wearable fabric 205 which has thickness "h".

The nature of the wearable fabric 205 is not particularly critical. Embodiments of the transmission line feed 215 could be functional on at least most common clothing fabrics. The thickness "h" of the fabric 205 is not critical in the functioning of the transmission line feed 215 but an advantage of embodiments of the transmission line feed 215 is that they remain robust even when designed for fabrics 205 of no more than 1 mm thickness. Indeed, they remain robust for use on clothes such as tee-shirts where the fabric 205 would commonly be no more than 0.5 mm.

The material of the transmission line feed 215 may be of any suitable conductive material and for experimental purposes might be for example copper tape. However, a suitable conductive material for use with wearable fabrics is Nora Dell Nickel-Copper-Silver plated nylon plain weave fabric, manufactured by Shieldex Trading Incorporated, with a quoted average resistivity of 0.005 Ω/sq. The antenna 100 and the ground plane 105, 110 of the balun in FIG. 1 and the transmission line feed 215 in FIG. 2 can be laser cut from this material.

Although other attachment techniques might be desirable in practice, a working embodiment of the invention can be constructed using adhesive TESA® tape (manufactured by TESA SE) applied to one side of the laser cut Nora Dell material. The backing is removed from the TESA tape and the design can be pressed on to the wearable fabric 205.

Using a conventional microstrip transmission line on a cloth substrate such as the wearable fabric 205 described above, with thickness ~0.3 mm, would mean that the widths of the transmission lines would have to be inconveniently small. For example, a 50 ohm track on cotton would have to be roughly 0.8 mm wide. Such a thin conducting line 200 is difficult to realize using metalized fabric as a thin strip of material will have a higher effective resistivity and will be prone to fray.

Wider tracks are possible however if the effective capacitance per unit length can be reduced. Referring to FIG. 3, in embodiments of the invention, sections of the ground plane 110 below the conducting line 200 are removed to form openings 300. A transmission line 215 of this kind will be affected by the proximity of the ground plane 110 to the body in use, and will also lose a little power due to induced currents in the body. However, these effects can be kept relatively small if the period of the openings 300 is much smaller than the carrier wavelength in the wearable fabric 205, for instance by a factor of five or even ten or more. According to some embodiments, the distribution of the apertures has a periodicity along the length of the transmission line which is greater than the carrier wavelength of signals to be carried in use of the transmission line. According to some embodiments, the distribution of the apertures has a periodicity along the length of the transmission line which is at least five times greater than the carrier wavelength of signals to be carried in use of the transmission line. According to some embodiments, the distribution of the apertures has a periodicity along the length of the transmission line which is at least ten times greater than the carrier wavelength of signals to be carried in use of the transmission line.

Using this method, the width of the conductor can be kept in a range which is practical to use and for which the line will remain relatively undamaged due to flexing of the wearable fabric. In this way, lines with impedances of .about.50 ohms and below may be realized with conductor widths typically in the range 2-10 mm.

Figure 3:
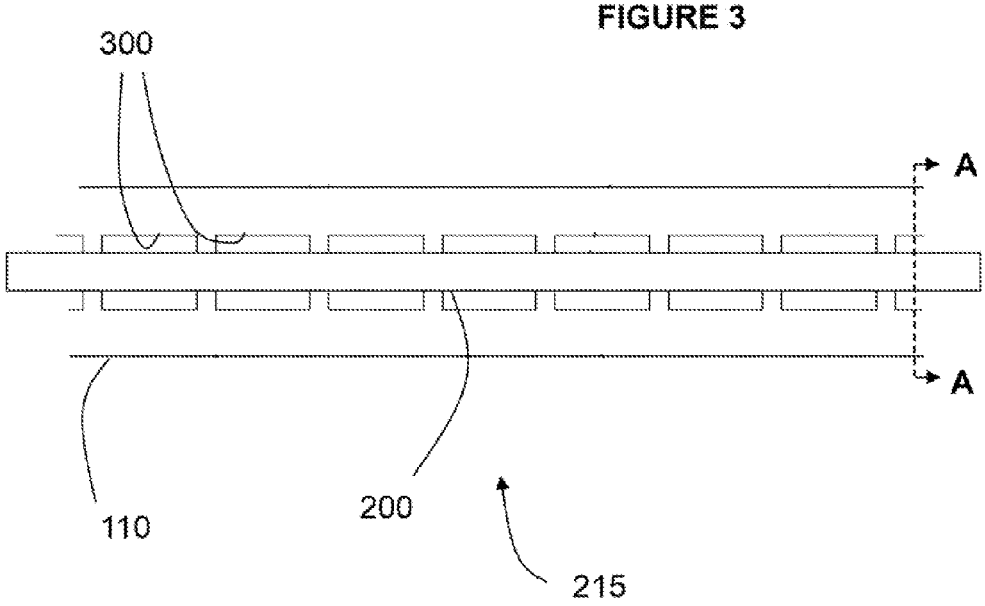
FIG. 3 shows a diagrammatic view from above of the line conductor and ground plane of a microstrip feed line according to an embodiment of the invention.
Figure 4:
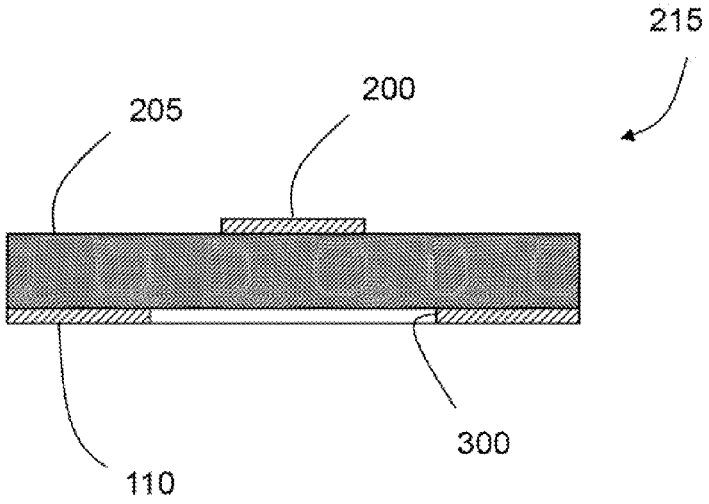
FIG. 4 shows a cross section of the microstrip feed line of FIG. 3, taken along the line A-A and viewed in the direction indicated by the arrows.

Referring to FIG. 4, a cross section of the transmission line 215 shown in FIG. 3, through one of the openings 300, shows the structure as similar to that of the conventional microstrip transmission line on a cloth substrate shown in FIG. 2, but having a perforated ground plane 110

Copper tape and the cotton fabric described above were used to construct a prototype of the transmission line 215 shown in FIG. 3, for testing purposes. The line 215 was 300 mm long and terminated in a parallel pair of 100Ω, surface-mounted resistors. The line conductor 200 was 3 mm wide. Rectangular openings 300 having dimensions 8 mm long×4 mm wide were made in the ground plane 110, spaced by 2 mm conducting sections, reducing the capacitance per unit length by a factor of approximately 5. Because the capacitance was reduced, the velocity factor of the line 215 was close to 1.0.

Figure 5:
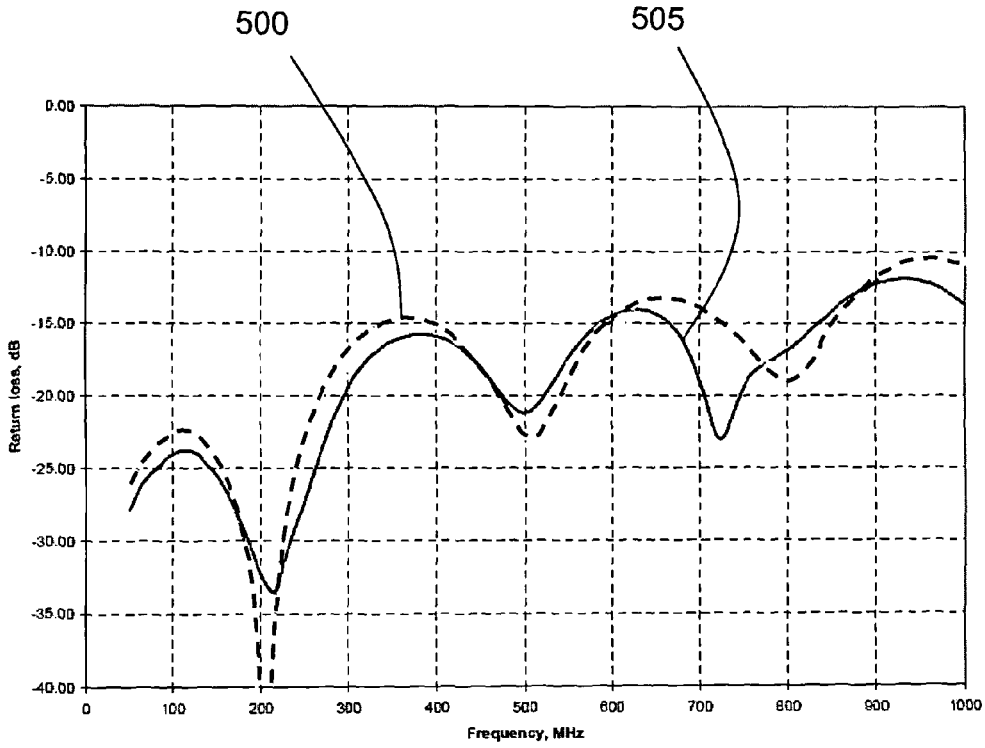
FIG. 5 shows a graph of the measured return loss of a transmission line according to FIGS. 3 and 4, 300 mm long and terminated at a 50 ohm load.

The return loss of the terminated line 215 shown in FIG. 3 was measured when the line 215 was isolated and when the grounded side' of the line was placed against the body, producing two curves 505, 500 respectively, as shown in FIG. 5 where return loss, as measured in dB, is plotted against frequency as measured in MHz.

This realisation of the feed line 215 with a punctured ground plane 110 is significantly easier to fabricate than one having dimensions as low as 0.8 mm.

As shown in FIGS. 3 and 4, the apertures 300 in the ground plane 110 are rectangular and periodic, providing a ladder-like structure. Neither of these characteristics is likely to be essential. For example, the apertures 300 might instead be circular, of varying size and/or irregularly spaced. However, they are preferably at least as wide as the line conductor 200 so as to have maximum effect in reducing the amount of ground plane 110 under the conductor 200 per unit length. An important factor is the ratio of material present in the ground plane 110 under the conductor 200 to the openings. In a periodic structure, this might be seen as the duty ratio of the ground plane 110. However, this ratio of material could range widely, depending on the thickness and dielectric constant of the material. For any particular material there should be some ratio which gives an impedance of 50 ohms. The ratio would therefore have to be determined in practice in light of the material used.

Referring to FIGS. 6 and 7, in a completed feed assembly for the bowtie antenna 100 of FIG. 1, a suitable balun 600 to connect the transmission line 215 to the antenna 100 is of known type, being a planar Marchand balun based on a pair of Lange couplers 605A, 605B and 610A, 610B. Such a balun is described in the paper "Novel miniaturised wideband baluns for MIC and MMIC applications" by Nguyen and Smith, in Electronics Letters, Volume 29, No. 12, published on 10 Jun. 1993.

The Marchand balun 600 consists of two parallel line couplers 605A, 605B and 610A, 610B, with one side of each coupler 605A, 610A connected to the ground plane 110 (FIG. 7) of the incoming transmission line 215. The other two lines 605B, 610B of the couplers are on the opposite side of the wearable fabric 205 (not shown in FIGS. 6 and 7) in use, being connected to the line conductor 200. The balun 600 also acts as a 4:1 impedance transformer, with an output of 200 ohms.

The layout and dimensions of the Marchand balun 600 as described above are particularly convenient for direct coupling to a dipole antenna as well as to a transmission line 215 as described above with reference to FIGS. 2 to 4.

Figure 8:
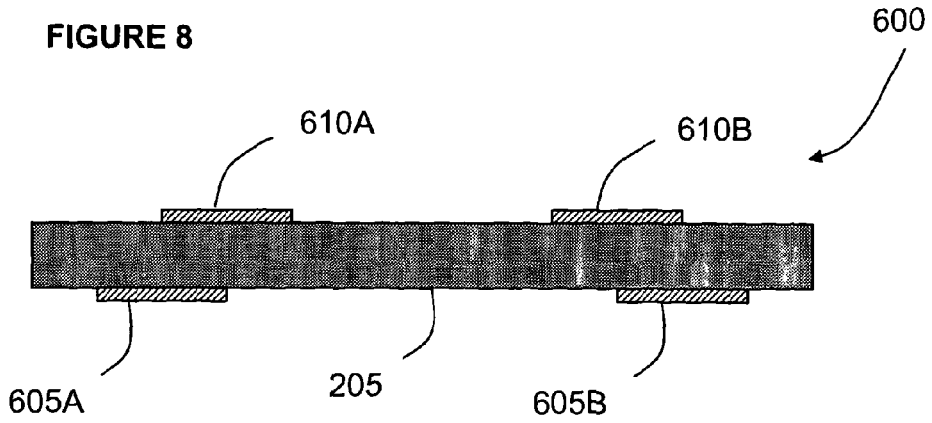
FIG. 8 shows a cross section of the balun of FIG. 7, taken along the line B-B and viewed in the direction indicated by the arrows.

Referring to FIG. 8, a cross section of the balun 600 shown in FIG. 7, using both sides of the wearable fabric 205, shows that overlapped coupled lines 605A, 605B and 610A, 610B are possible. The optimum coupling value for the couplers is 6.99 dB when the balun 600 has a 4:1 ratio between the output and input impedances.

A prototype balun 600 was constructed using copper tape as the coupled lines 605, 610 placed on both sides of a 0.2 mm polyester substrate. The estimated dielectric constant of polyester film is approximately 3.2, similar to that of cotton fabric substrate 205, so that structures on the film have dimensions similar to those on the textile. The prototype balun 600 was 200 mm long by 25 mm wide, with 5 mm wide tracks. To realise the correct coupling value, the tracks were separated by ~0.2 mm. The balun 600 was terminated in a 200 ohm resistor and connected to a 50 ohm flexible coaxial cable. The centre conductor of the coaxial cable was soldered to one of the inner lines and the outer was soldered to the point where the outer lines are connected to form a quarter-wave stub.

Figure 9:
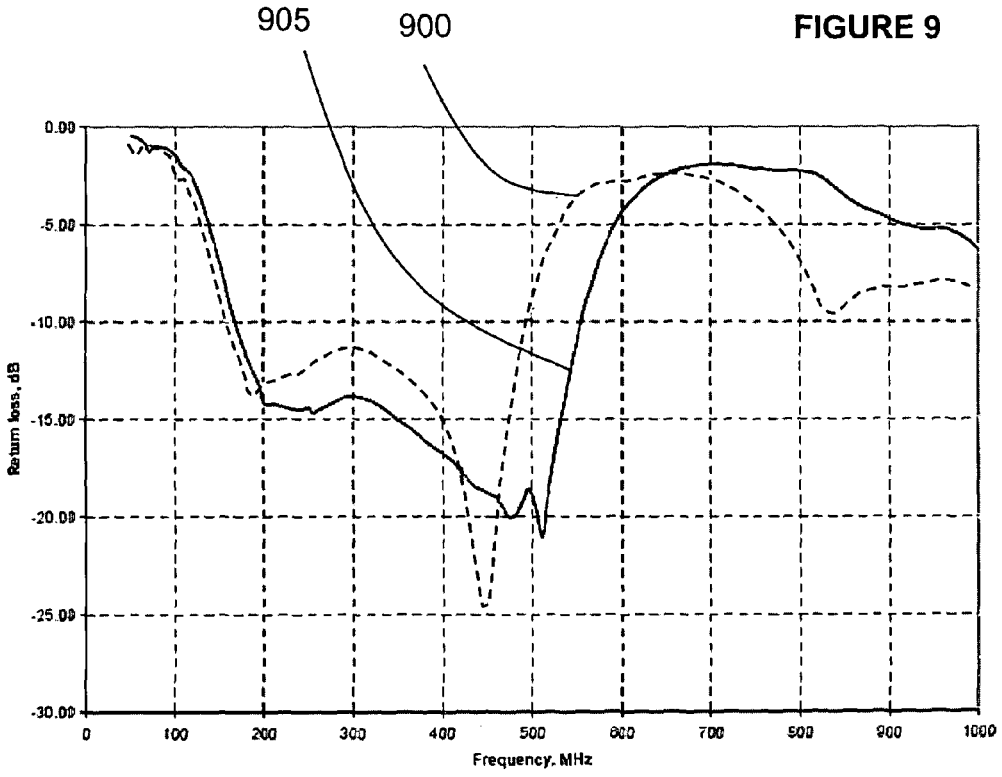
FIG. 9 shows a graph of the measured return loss of a balun according to FIGS. 7 and 8.

The measured return loss (dB) of this balun 600 is shown in FIG. 9, plotted against frequency (MHz). The return loss was measured when the ground plane 605 of the balun 600 was isolated and when it was placed against the body, producing two curves 905, 900 respectively. (The effect of the body is variable and only one case is shown.) In isolation, the balun 600 has a reasonable return loss from 200-500 MHz. The upper end of the frequency band is reduced by the proximity of the body.

A bowtie antenna 100 fed with a Marchand balun 600 as described above was modelled. With the antenna 100 in vacuum, the real part of the complex impedance at the input to a nominal 50 ohm line oscillated around approximately 50 ohms across the 100-500 MHz band. The return loss indicated reasonable radiation efficiency from 100-500 MHz.

Figure 10:
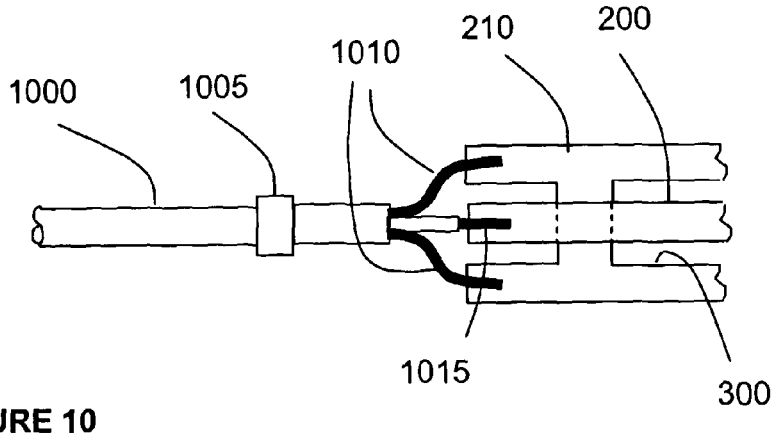
FIG. 10 shows a plan view of an arrangement for connecting the transmission line of FIGS. 3 and 4 to a radio.

Referring to FIG. 10, a transmission line according to an embodiment of the invention will generally need to be connected to a radio in use. This can be done for example by using a length of coaxial cable 1000 connected to the TNC ("threaded Neill-Concelman") plug of the radio. The free end is held to the wearable fabric 205 (not shown in FIG. 10) by using a clip or plastic tie wrap 1005 such as TYWRAP® and the outer braid divided into two parts 1010 and attached to the ground plane 210 of the transmission line using a conductive epoxy resin such as silver-filled ARALDITE®. The inner conductor 1015 is similarly attached to the line conductor 200 of the transmission line.

Embodiments of the invention are suitable for use at radio frequencies, for example together with Multiband Inter/Intra Team Radios ("MBITRs").

The invention claimed is:

1. An antenna feed structure for use with a wearable antenna, the feed structure comprising:

a flexible non-conductive fabric material; and a microstrip transmission line having a line conductor and a ground plane, the line conductor mounted on a first side of the flexible non-conductive fabric material and the ground plane mounted on a second side of the flexible non-conductive fabric material that is opposite to the first side, the ground plane having a series of apertures formed therein, the apertures at least partially overlying the line conductor;

wherein the distribution of the apertures has a periodicity along the length of the transmission line which is greater than a carrier wavelength of signals to be carried in use of the transmission line.

2. The antenna feed structure according to claim 1 wherein the distribution of the apertures has a periodicity along the length of the transmission line which is at least ten times that of the carrier wavelength of signals to be carried in use of the transmission line.

3. The antenna feed structure according to claim 1 wherein all of the apertures are at least as wide as the line conductor.

4. The antenna feed structure according to claim 1 wherein at least some of the apertures are at least as wide as the line conductor.

5. The antenna feed structure according to claim 1 further comprising a balun, and wherein the ground plane of the transmission line is extended beyond the line conductor to provide a ground plane for the balun.

6. The antenna feed structure according to claim 5 wherein the material of the ground plane of the balun is extended to provide the antenna.

7. The antenna feed structure according to claim 1 wherein the microstrip transmission line has an impedance, in use, in the range 35 to 65 ohms.

8. The antenna feed structure according to claim 1 wherein the line conductor has a width in the range 2 mm to 10 mm.

9. The antenna feed structure according to claim 1 wherein the microstrip transmission line is constructed out of metallized fabric.

10. The antenna feed structure according to claim 1 wherein the line conductor extends centrally with respect to the apertures when the microstrip transmission line is mounted on the flexible material.

11. The antenna feed structure according to claim 1 wherein the distribution of the apertures has a periodicity along the length of the transmission line which is at least five times that of the carrier wavelength of signals to be carried in use of the transmission line.

12. A wearable antenna assembly comprising an antenna feed structure, the feed structure comprising:

a flexible non-conductive fabric material; and a microstrip transmission line having a line conductor and a ground plane, the line conductor mounted on a first side of the flexible non-conductive fabric material and the ground plane mounted on a second side of the flexible non-conductive fabric material that is opposite to the first side, the ground plane having a series of apertures formed therein, the apertures at least partially overlying the line conductor;

wherein the distribution of the apertures has a periodicity along the length of the transmission line which is greater than a carrier wavelength of signals to be carried in use of the transmission line.

* * * * *